US009273507B2

(12) United States Patent
Petrat

(10) Patent No.: US 9,273,507 B2
(45) Date of Patent: Mar. 1, 2016

(54) AIRPORT HANGAR DOOR

(71) Applicant: Carl S. Petrat, Sarasota, FL (US)

(72) Inventor: Carl S. Petrat, Sarasota, FL (US)

( * ) Notice: Subject to any disclaimer, the term of this patent is extended or adjusted under 35 U.S.C. 154(b) by 0 days.

(21) Appl. No.: 14/603,802

(22) Filed: Jan. 23, 2015

(65) Prior Publication Data

US 2015/0204131 A1 Jul. 23, 2015

Related U.S. Application Data

(60) Provisional application No. 61/930,724, filed on Jan. 23, 2014.

(51) Int. Cl.

| | |
|---|---|
| ***E05D 15/40*** | (2006.01) |
| ***E05F 15/53*** | (2015.01) |
| ***E06B 3/01*** | (2006.01) |
| ***E06B 3/50*** | (2006.01) |
| *E05F 3/04* | (2006.01) |
| *E06B 3/70* | (2006.01) |

(52) U.S. Cl.

CPC . *E05F 15/53* (2015.01); *E06B 3/01* (2013.01); *E06B 3/5018* (2013.01); *E05F 3/04* (2013.01); *E06B 2003/7044* (2013.01)

(58) Field of Classification Search

CPC ..... E05F 15/53; E05F 3/04; E06B 3/38; E06B 3/70

USPC ..... 49/197, 199, 201, 202, 203, 204, 205

See application file for complete search history.

(56) References Cited

U.S. PATENT DOCUMENTS

| | | | | | |
|---|---|---|---|---|---|
| 663,989 | A | * | 12/1900 | Wilson | 49/197 |
| 1,709,278 | A | | 4/1929 | Officer | |
| 1,843,973 | A | * | 2/1932 | Dickason | 49/204 |
| 1,980,303 | A | * | 11/1934 | Thompson | 49/200 |
| 2,080,904 | A | * | 5/1937 | Wanner | 49/197 |
| 2,163,394 | A | * | 6/1939 | Clark | 49/204 |
| 2,244,642 | A | | 6/1941 | Ferris et al. | |
| 2,260,080 | A | | 10/1941 | Lane | |
| 3,464,161 | A | * | 9/1969 | Jonsson | 49/197 |
| 4,442,631 | A | * | 4/1984 | Weber | 49/199 |
| 4,765,093 | A | | 8/1988 | Edwards, Jr. | |
| 4,819,376 | A | | 4/1989 | Taddei | |
| 4,888,379 | A | | 12/1989 | Henning et al. | |
| 4,971,129 | A | | 11/1990 | Townend | |
| 5,027,554 | A | | 7/1991 | Parker | |
| 5,239,776 | A | * | 8/1993 | Lhotak | 49/199 |
| 5,373,663 | A | | 12/1994 | Turini | |
| 7,219,711 | B2 | * | 5/2007 | Keller et al. | 160/213 |
| 8,245,446 | B2 | * | 8/2012 | Betker | 49/199 |
| 8,539,716 | B2 | | 9/2013 | Betker | |
| 2002/0029524 | A1 | * | 3/2002 | Kerkvliet | 49/200 |
| 2008/0086947 | A1 | * | 4/2008 | Crown | 49/199 |

FOREIGN PATENT DOCUMENTS

| | | | |
|---|---|---|---|
| CN | 203403781 | U | 1/2014 |
| EP | 1312742 | A2 | 5/2003 |

* cited by examiner

*Primary Examiner* — Jerry Redman

(74) *Attorney, Agent, or Firm* — Dinsmore & Shohl LLP

(57) ABSTRACT

A door assembly for providing access to an enclosed space such as an airplane hangar. The door assembly includes a door panel configured to open and close an opening is provided. The door assembly includes an actuator configured to drive a rod upwardly. A first pin is fixedly mounted to the rod and rotatably mounted to the door. A link limits the upward advancement of a top portion of the door. The door is carried upward by the first pin, and rotated about the first pin as the link limits the upward advancement of the top portion of the doors.

14 Claims, 7 Drawing Sheets

AIRPORT HANGAR DOOR

CROSS-REFERENCE TO RELATED APPLICATIONS

This application claims priority of U.S. Provisional Application 61/930,724 filed Jan. 23, 2014, the contents of which are incorporated herein by reference.

FIELD OF THE INVENTION

The present invention relates generally to doors. More particularly, the present invention relates to a hydraulically actuated door for an enclosed space such as an airplane hangar.

BACKGROUND OF THE INVENTION

Overhead doors for buildings, particularly airport hangar doors, which have a displaceable panel movable toward the interior of the building by means of vertical tracks are well known in the art. These doors are sometimes balanced by counterweights or springs. These doors require numerous moving parts and are expensive to assemble and manufacture. These doors also require large motors or actuators to move the door from a closed position to an open position.

There are overhead doors which include a curved track and rollers riding in the track to move the doors from the closed position to the overhead open position. These doors are subject to problems caused by the rollers jamming in the curved portions of the track. Also such constructions are costly to manufacture and maintain.

There exists a need in the art to provide a door for an airport hangar and the like which is simple to install and manufacture without requiring the use of a large motor or actuator.

SUMMARY OF THE INVENTION

A door assembly having a door panel configured to open and close an opening is provided. The door assembly includes a door panel, an actuator configured to drive a rod upwardly, a link configured to limit the upward advancement of a top portion of the door panel, and a first pin fixedly mounted to the rod and pivotably mounted to the door panel. The first pin is configured to both carry the door panel upwardly with the advancement of the rod and also allow the body of the door panel to rotate about the first pin so as to provide access to the opening. The door panel rotates about the first pin as a result of the link limiting the upward advancement of the top portion of the door panel.

DETAILED DESCRIPTION OF THE INVENTION

A door assembly having a door panel configured to open and close an opening is provided. The door assembly includes an actuator configured to drive a rod upwardly and a link configured to limit the upward advancement of a top portion of the door panel, and a first pin fixedly mounted to the rod and rotatably mounted to the door panel. The first pin is configured to both carry the door upwardly with the advancement of the rod and also allow the body of the door to rotate about the first pin so as to provide access to the opening.

Figure 1:
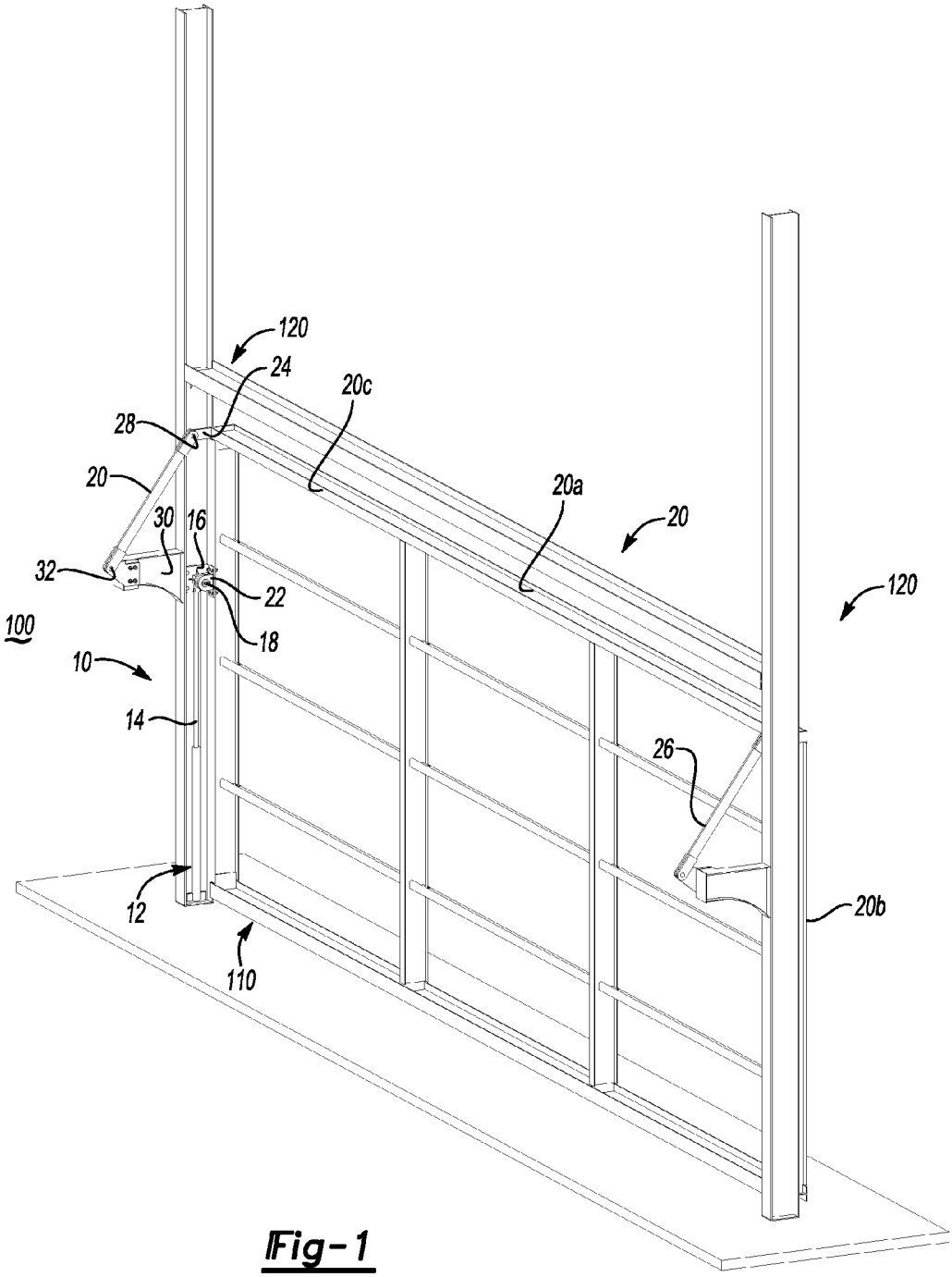
FIG. 1 is an isometric view of the door assembly from the inside of an enclosed space looking out.

FIG. 1 is a perspective view of the door assembly 10 taken from within an enclosed space 100. The enclosed space 100 includes an opening 110. The enclosed space 100 may be an airplane hangar and the opening 110 may be dimensioned to allow an airplane to drive through. The enclosed space 100 includes a pair of tracks 120. The tracks 120 are spaced apart from each other and generally define the side boundary of the opening 110. The tracks 120 are formed of a generally durable and rigid material such as steel. The tracks 120 are elongated members having a generally H-shaped cross section. However, it should be appreciated that the track 120 is configured to provide a guide for axial movement, and thus may be U-shaped, C-shaped or otherwise. The tracks 120 are disposed along a generally vertical axis. The door assembly 10 is shown having a pair of actuators 12, although it should be appreciated by those skilled in the art that only one actuating unit is necessary for the functioning of the door assembly 10.

Figure 2:
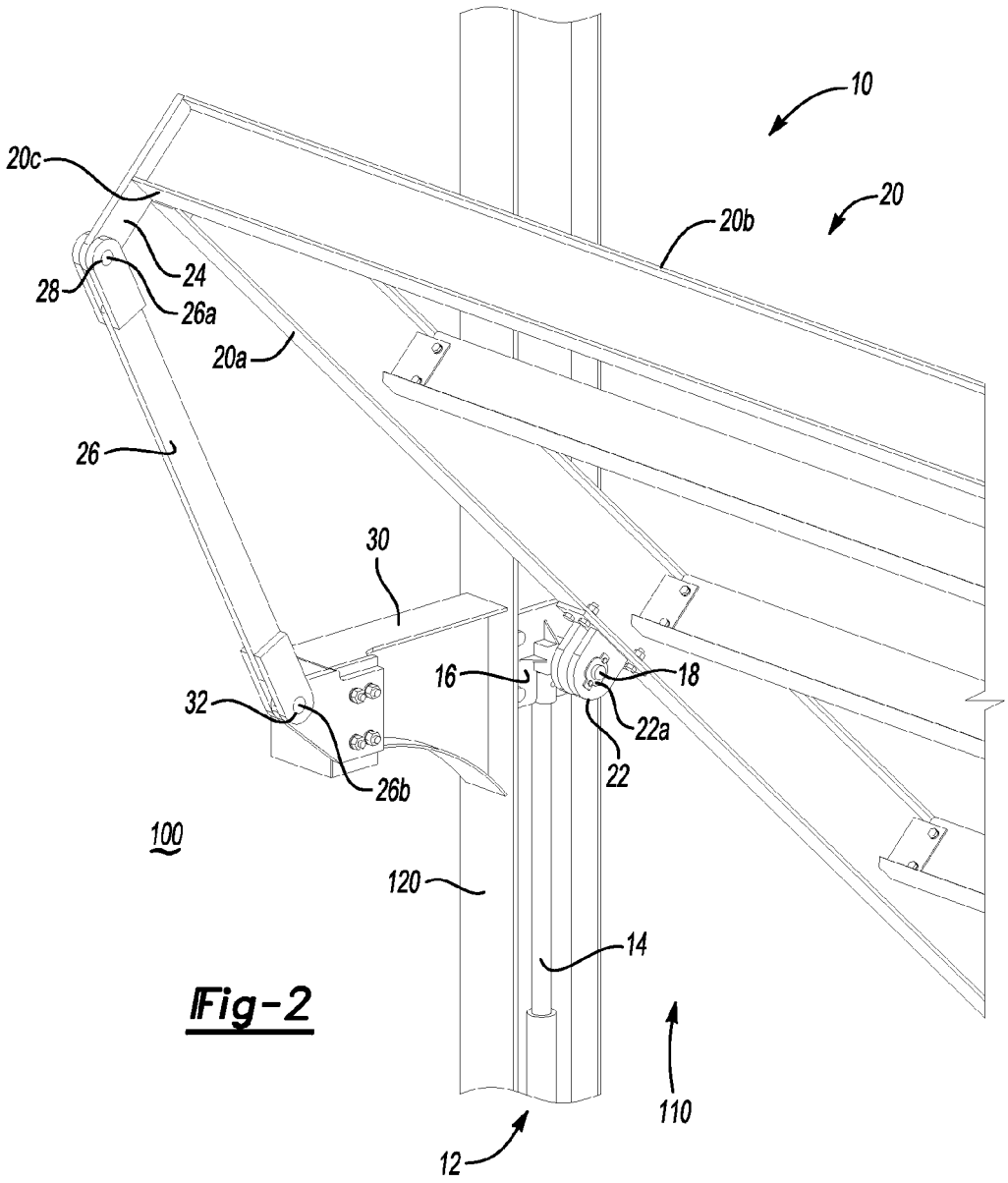
FIG. 2 is a close up view showing the door assembly in a partially open position.

With reference now to FIG. 2, the actuators 12 have a rod 14 and a shoe 16. The rod 14 is disposed within the track 120. The shoe 16 may be fixedly mounted to a distal end of the rod 14. The shoe 16 includes a first pin 18. The first pin 18 is generally orthogonal to the axial length of the rod 14. The actuator 12 may be electrically, hydraulically or pneumatically driven. Preferably, the actuator 12 is a hydraulic cylinder as a hydraulic cylinder is narrow enough to fit within the track 120 and thus occupies minimal space. The actuator 12 may be controlled by a Programmable Logic Controller ("PLC") as shown in FIGS. 3-6. The rods 14 are disposed within each of the tracks 120. Only one of the actuators 12 will be described but it should be clear the actuators 12 are substantially identical and thus an explanation of one of the actuators 12 is sufficient to describe both.

Each hydraulic actuator 12 is configured to advance the rod 14 upwardly and also downwardly in a synchrony with each other. The rod 14 may be advanced upwardly so as to open the door panel 20, or retreated so as to close the door panel 20. The shoe 16 is a generally solid block member formed of a durable and rigid material such as steel. The first pin 18 is generally centered on an interior surface of the pin support and extends inwardly towards the side of the door.

The door assembly 10 includes a door panel 20 having an interior surface 20*a* and an exterior surface 20*b*. A pair of first pin supports 22 is fixedly mounted to the interior surface of the door panel 20 on opposite sides of each other. The first pin support 22 is a formed of a generally durable and rigid material and is fixed to the door panel 20 so as to be able to elevate the door and support a rotational load exerted by the door panel 20.

Each first pin support 22 includes a bore 22*a* configured to rotatingly receive a corresponding first pin 18 so as to rotate the door panel 20 about the first pin 18. The first pin 18 is further configured to carry the first pin support 22 along with the door panel 20 as the shoe 16 travels up and down along the respective track 120. It should be appreciated that the door panel 20 will travel with the shoe 16 as the shoes 22 are fixedly mounted to the door panel 20.

The door assembly 10 further includes a pair of second pin supports 24 and a link 26. The second pin supports 24 include a second pin 28 and is configured to rotatably engage the link 26. The second pin support 24 is fixedly mounted on a top portion 20*c* of the interior surface 20*a* of the door panel 20. The second pin support 24 is formed of a generally durable and rigid material configured to support the weight of the door panel 20.

The link 26 includes a top pin hole 26*a* and a bottom pin hole 26*b*. The top pin hole 26*a* is configured to receive the second pin 28 so as to rotatably connect a top end of the link 26 to the second pin support 24. The door assembly 10 may further include a pair of link arms 30. Each link arm 30 is fixedly mounted to the each of the tracks 120. The link arm 30 includes a third pin 32. The bottom pin hole 26*b* of the link 26 is rotatably attached to the third pin 32. Thus, the bottom end of the link 26 is rotatably attached to the link arm 30.

In operation, the actuator 12 moves the door panel 20 from a closed position to an open position by driving the rod 14 upward. As the rod 14 moves upwards, the shoe 16 carries the first pin support 22 and thus the door panel 20. The link 26 limits the upward advancement of the top portion 20*c* of the door panel 20 by engagement with the second pin 28 and the third pin 32, thus the upward movement of the shoe 16 translates into a rotation of the link 26 which pulls the top portion 20*c* of the door panel 20 downwardly simultaneously rotating the bottom portion 20*d* of the door panel 20 upwardly. As the rod 14 advances to its highest position along the side track 120, the link 26 continues to pull the top portion 20*c* of the door panel 20 down, raising the bottom portion 20*d* of the door panel 20 up while simultaneously raising the door panel 20 above the ground until the door panel 20 is elevated and resting along a plane generally parallel to the ground.

As the door panel 20 moves from a closed position to an open position, the link 26 swings from a first position to a second position. The first position as compared to the second position of the link arm 30 varies by X degrees where X degrees ranges between 50 and 90 degrees.

Figure 3:
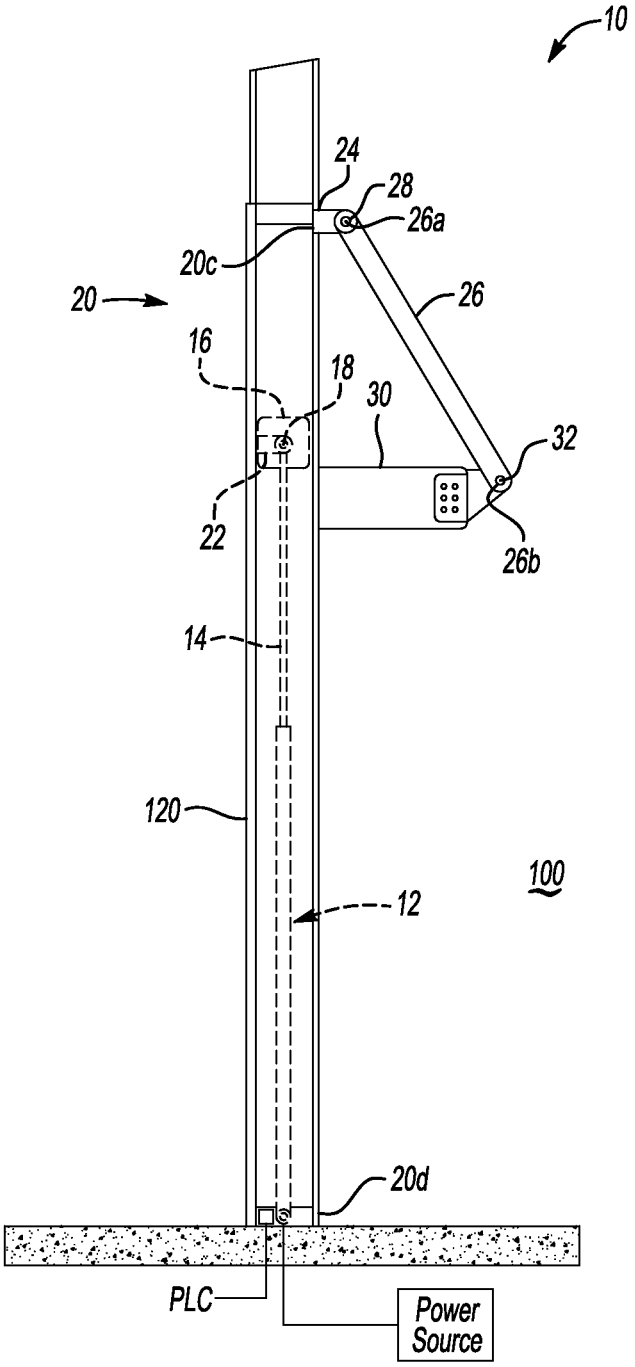
FIG. 3 is a side view of the door assembly in a closed position.

With reference now to FIGS. 3-6, an operation of the door assembly 10 is provided. FIG. 3 illustrates the first pin support 22 and the shoe 16 at its lowest position. The door panel 20 is disposed along a generally vertical plane and covers the opening 110 of the enclosed space 100. The link 26 is angled acutely with respect to a top surface of the link arm 30.

Figure 4:
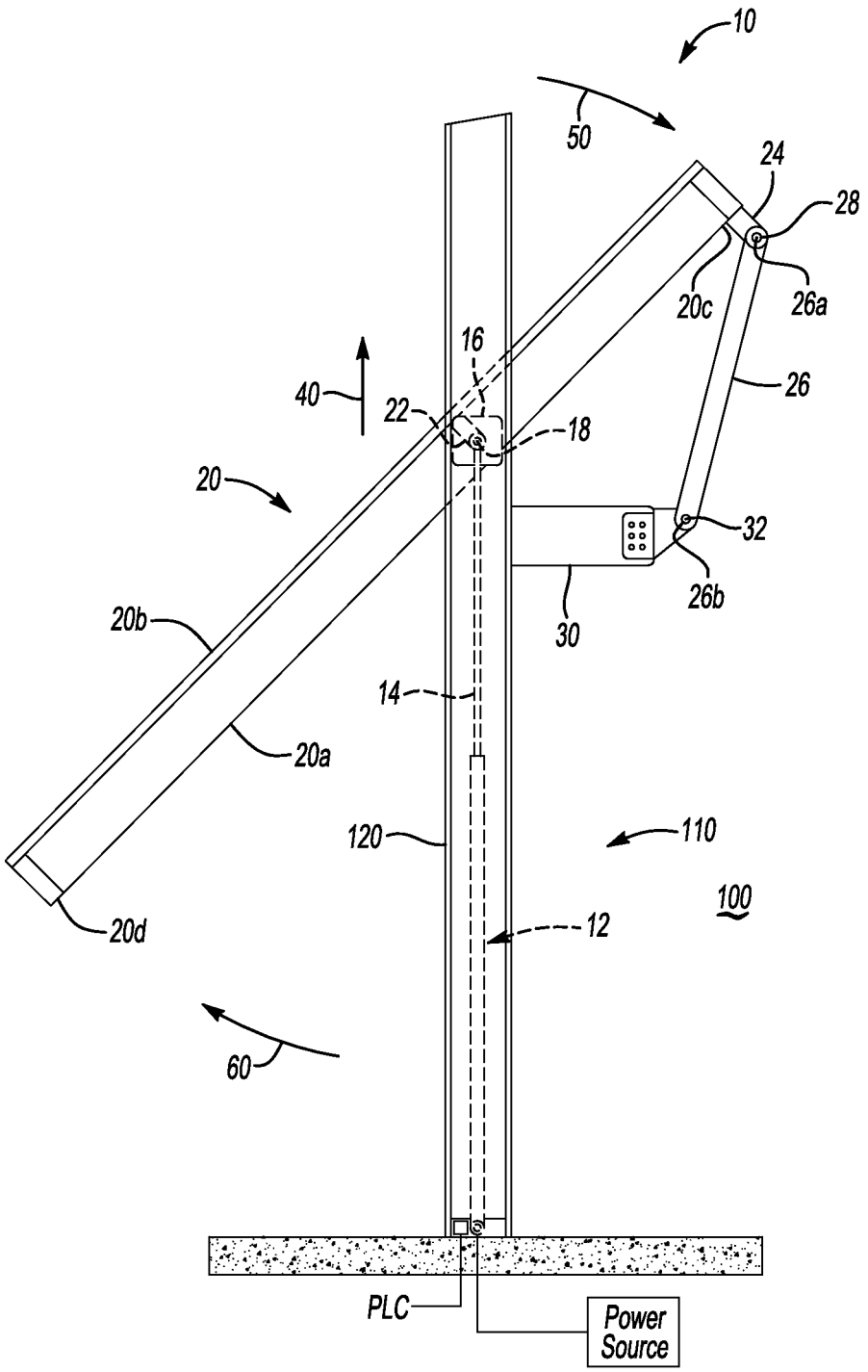
FIG. 4 is a side view of door assembly in a partially open position.

FIG. 4 illustrates the door assembly 10 in a partially open position. The first pin support 22 and the shoe 16 are driven upwardly so as to be elevated with respect to their position in FIG. 3. As the door panel 20 moves upwards (as indicated by arrow 40), the top portion 20*c* of the door panel 20 is limited in its upward advancement by the link 26, and thus the link 26 begins rotating from an acute angle to an obtuse angle with respect to the top surface of the link arm 30 relative to FIG. 3, as indicated by arrow 50. FIG. 4 shows the link 26 in a generally vertical position. As the link 26 rotates, the top portion 20*c* of the door panel 20 is pulled down, simultaneously moving the bottom portion 20*d* of the door panel 20 upwardly as shown by arrow 60. Thus, the link 26 is shown directing and pulling the door panel 20 towards a generally horizontal position as the first pin support 22 carries the door panel 20 upwardly with the travel of the shoe 16.

Figure 5:
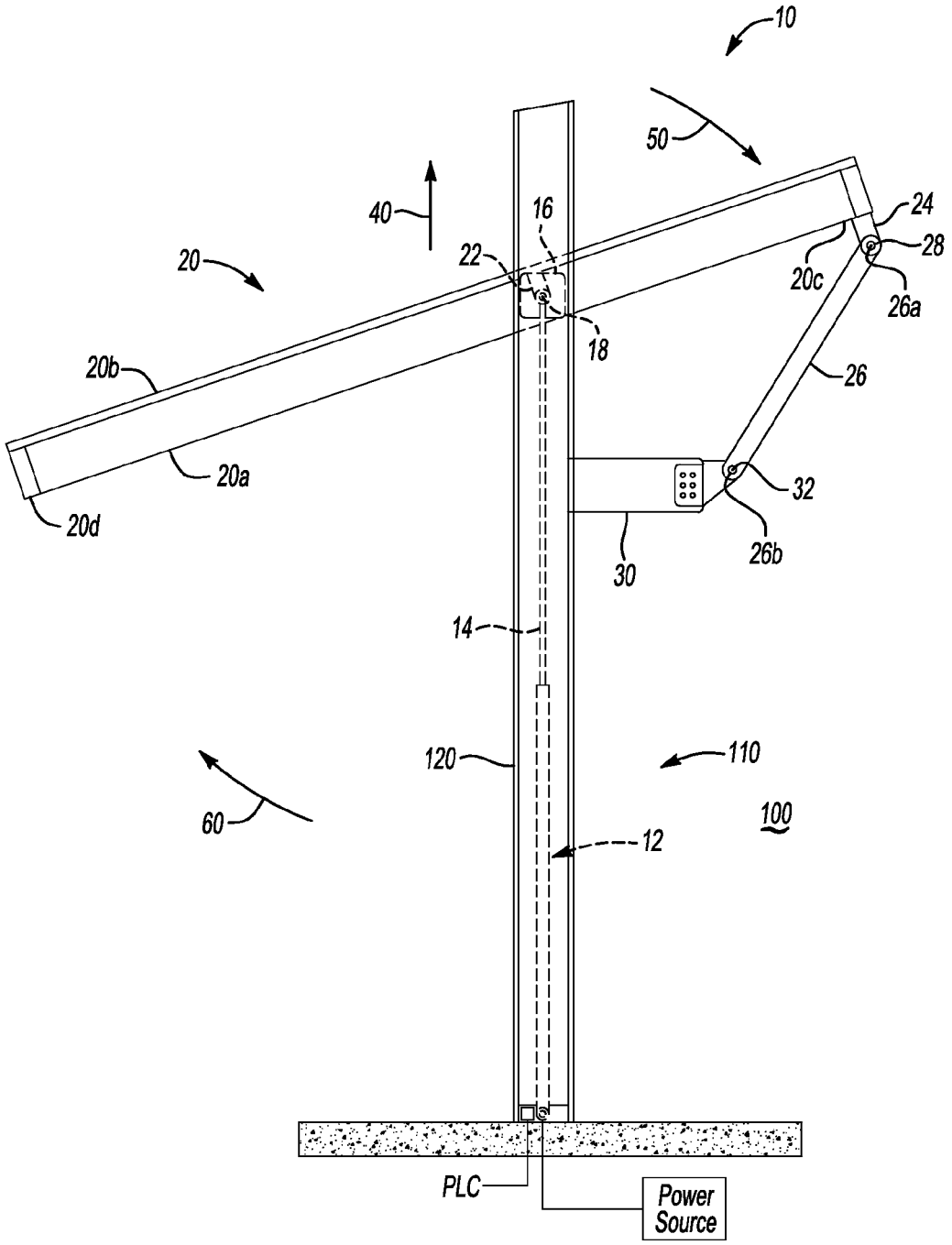
FIG. 5 is a side view of the door assembly advanced further relative to FIG. 4.

FIG. 5 illustrates the door panel 20 in an almost fully open position. As is shown, the shoe 16 has advanced further up along the track 120, relative to FIG. 4 as indicated by arrow 40. The link 26 continues to restrict upward movement of the top portion 20*c* of the door panel 20, thus the first pin support 22 and the door panel 20 rotate further about the first pin 18 relative to FIG. 4 as indicated by arrow 50. The bottom end of the link 26 rotates further about the third pin 32 relative to FIG. 4 as indicated by arrow 60.

Figure 6:
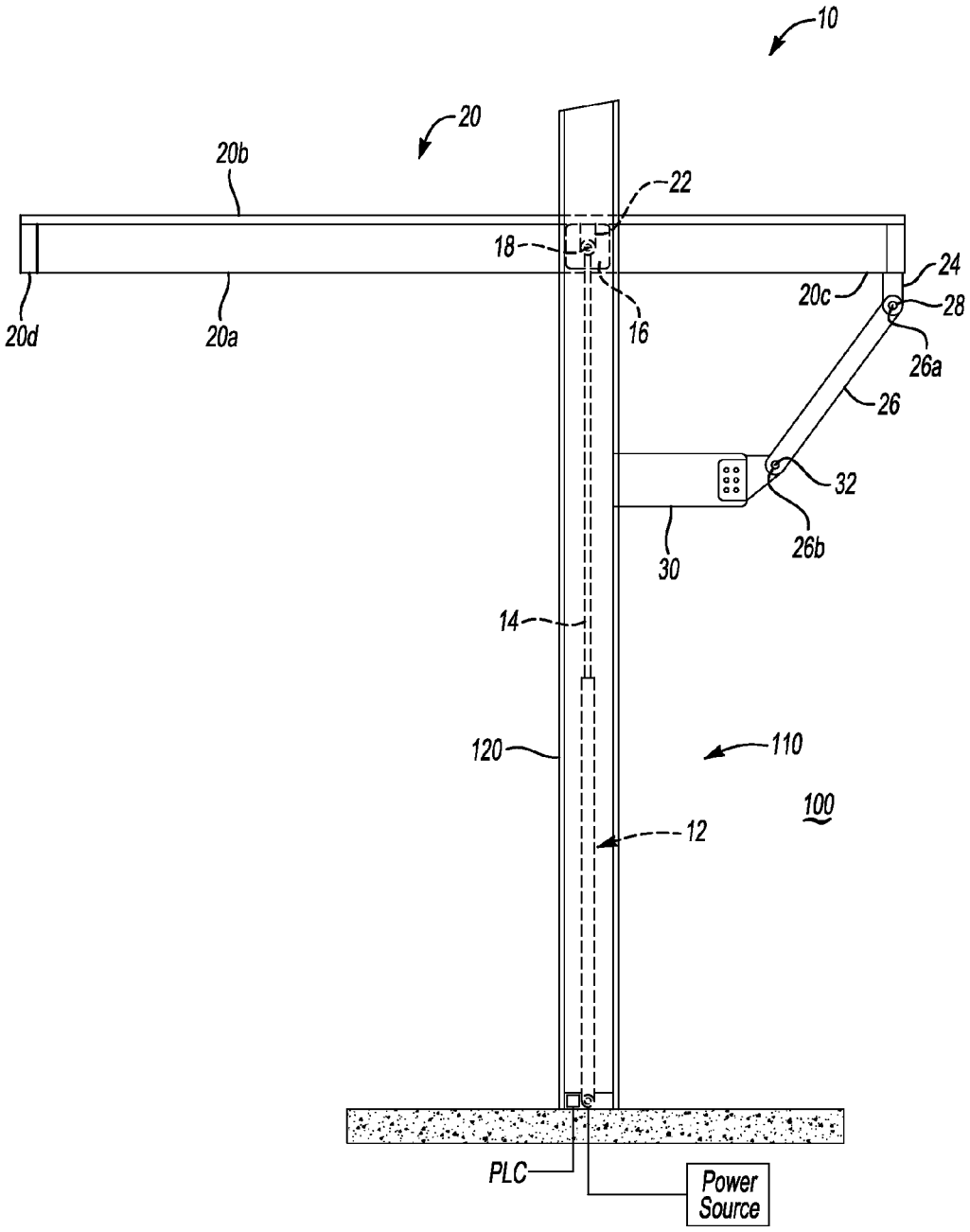
FIG. 6 is a side view of the door assembly in a fully open position.

FIG. 6 illustrates the door panel 20 of the door assembly 10 in a fully open position, wherein the door panel 20 is disposed along a generally horizontal position. The shoe 16 is elevated higher relative to what is shown in FIG. 5, wherein and the door panel 20 is elevated to the top of the track 120. The link 26 continues to restrict upward movement of the top portion 20*c* of the door panel 20, thus the first pin support 22 and the door panel 20 rotate further about the first pin 18 relative to FIG. 5. The bottom end of the link 26 rotates further about the third pin 32 relative to FIG. 5. The top portion 20*c* of the door panel 20 is further rotated downwardly, and simultaneously the bottom of the door panel 20 is rotated upwardly.

Figure 7:
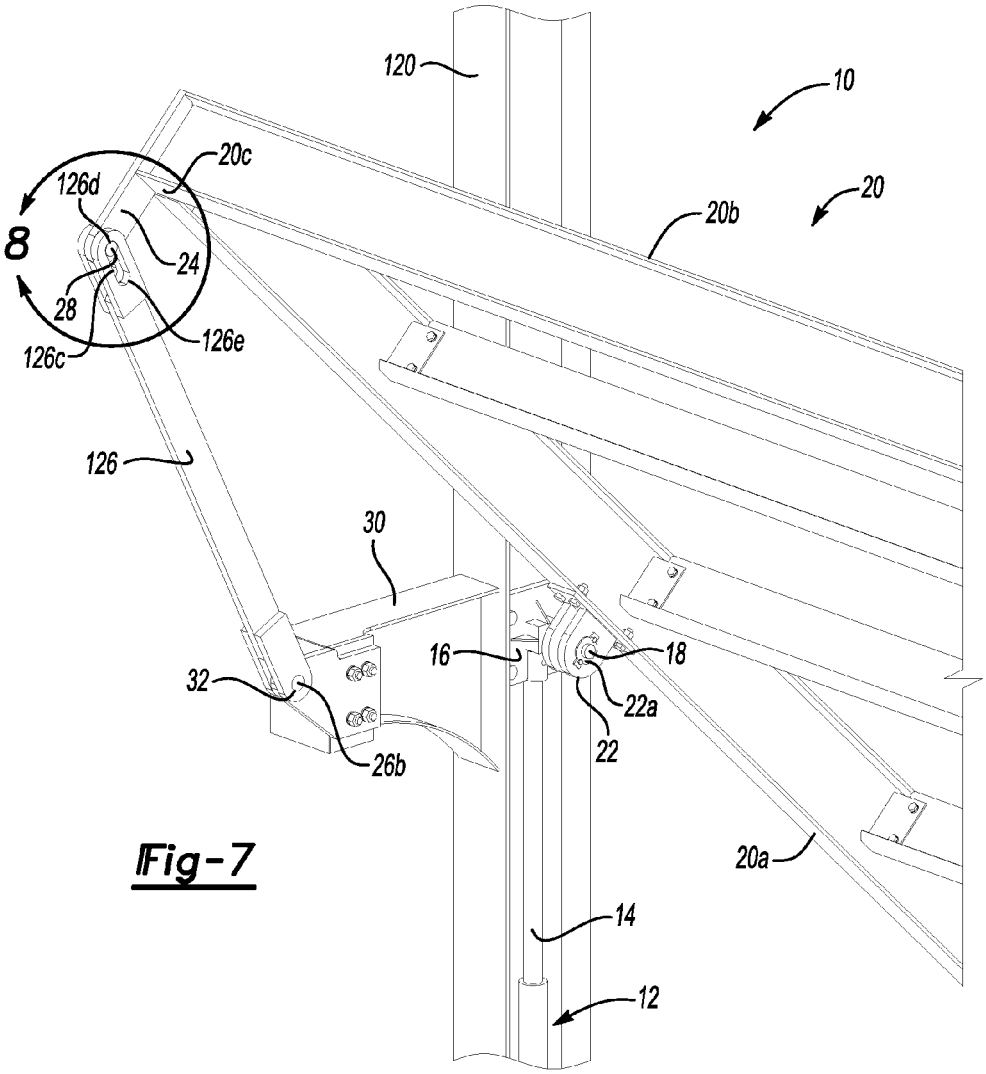
FIG. 7 is a perspective view of an embodiment of the link.

FIG. 7 shows an embodiment of the link 26 wherein the top pinhole 26*b* of the link is an elongated slot 126*c*. The second pin 28 is fixedly mounted to the second pin support 24. The elongated slot 126*c* is configured to allow the bottom portion 20*d* of the door panel 20 to be raised a predetermined height before the door panel 20 begins rotation about the first pin 18. Such a function may be desirable in instances where the door assembly 10 is used in an environment where snow fall may accumulate. Specifically, the slot allows the bottom of the door panel 20 to clear snow accumulation of a predetermined depth so as to avoid placing added load to the actuator 12.

Figure 8:
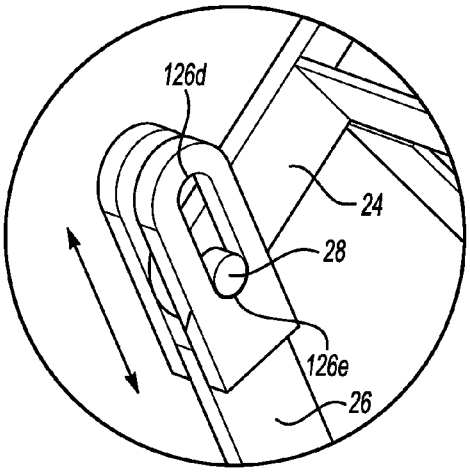
FIG. 8 is a close up view of the link shown in FIG. 7.

With reference now to FIG. 8, the operation of the elongated slot 126*b* is provided. The elongated slot 126*c* includes a top end 126*d* and a bottom end 126*e*. The second pin 28 is disposed on the bottom end 126*e* of the elongated slot. As the rod 14 is driven upward, the second pin 28 travels towards the top end 126*d* of the elongated slot 126*c*, simultaneously, the first pin 18 carries the door panel door upwardly along a vertical plane, wherein the bottom portion 20*d* of the door panel 20 is lifted. When the second pin 28 engages the top end of the slot 126*d*, the link 26 prevents the top portion 20*c* of the door panel 20 from advancing upwards and guides the top portion 20*c* of the door panel 20 downwardly in the same manner as described above. However, as the bottom of the door panel 20 is raised, the bottom of the door panel 20 may begin its outward rotation free and clear of the snow accumulation, and avoids a load resulting from having to push the snow accumulation out of the way.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art.

The invention claimed is:

1. A door assembly for providing access to an enclosed space having an opening, the door assembly having a door covering the opening, a pair of spaced apart tracks defining the sides of the opening, the door comprising:

a door panel disposed between the pair of tracks;

at least one actuator, the at least one actuator having a rod, the at least one actuator configured to move the rod up and down along one of the pair of tracks;

a first pin fixed to the rod, the door panel pivotably mounted to the first pin;

a link arm mounted to an interior surface of one of the pair of tracks, the link arm being a generally elongated member generally orthogonal to the pair of tracks;

a link having a top end and a bottom end, the top end pivotally connected to a top portion of the door panel, the bottom end pivotably connected to a distal end of the link arm, the link configured guide the door from a closed vertical position to an open horizontal position, wherein movement of the rod from a bottom position to a top position simultaneously lifts the door and rotates the door about the first pin, and wherein the top end of the link remains above the link arm, and wherein the link limits the upward advancement of the door panel so as to guide a top portion of the door downwardly so as to provide access to the enclosed space.

2. The door assembly as set forth in claim 1, further including a shoe, the shoe mounted to a distal end of the rod, the first pin fixedly mounted to the shoe and pivotably mounted to the door panel.

3. The door assembly as defined in claim 1, wherein the at least one actuator is a pair of actuators, the shoe is a pair of shoes, and the link is a pair of links, each of the pair of actuator is disposed on a respective pair of spaced apart tracks, each of the pair of shoes is mounted to opposite sides of the door, each of the pair of links is rotatable mounted to opposite sides of the top portion of the door panel, wherein the pair of actuators move the rod in synchrony with each other.

4. The door assembly as set forth in 1, wherein the top end of the link includes an elongated slot, the top portion of the door panel having a second pin configured to travel within the elongated slot.

5. The door assembly as set forth in claim 1, wherein the actuator is a hydraulic cylinder.

6. The door assembly as set forth in claim 1, further including a first pin support fixedly mounted on the door panel, the first pin support having a bore configured to rotatingly receive the first pin.

7. The door assembly as set forth in claim 1, further including a second pin support having a second pin, the second pin support fixedly mounted to a top portion of the door panel, a top end of the link rotatably mounted to the second pin.

8. A door assembly for providing access to an airplane hangar having an opening, the door assembly comprising:

a pair of spaced apart tracks, each of the tracks is elongated and disposed along a generally vertical axis;

a door panel disposed between the pair of tracks;

at least one actuator, the at least one actuator having a rod, the rod disposed within one of the pair of tracks, the at least one actuator configured to move the rod up and down along one of the pair of tracks;

a first pin fixed to the rod, the door panel pivotably mounted to the first pin;

a link arm mounted to an interior surface of one of the pair of tracks, the link arm being a generally elongated member generally orthogonal to the pair of tracks a link having a top end and a bottom end, the top end pivotally connected to a top portion of the door panel, the bottom end pivotably connected to a distal end of the link arm, the link configured guide the door from a closed vertical position to an open horizontal position, wherein movement of the rod from a bottom position to a top position simultaneously lifts the door and rotates the door about the first pin, and wherein the top end of the link remains above the link arm, and wherein the link limits the upward advancement of the door panel so as to guide a top portion of the door downwardly so as to provide access to the enclosed space.

9. The door assembly as set forth in claim 8, further including a shoe, the shoe mounted to a distal end of the rod, the first pin fixedly mounted to the shoe and pivotably mounted to the door panel.

10. The door assembly as defined in claim 8, wherein the at least one actuator is a pair of actuators, the shoe is a pair of shoes, and the link is a pair of links, each of the pair of actuator is disposed on a respective pair of spaced apart tracks, each of the pair of shoes is mounted to opposite sides of the door, each of the pair of links is rotatable mounted to opposite sides of the top portion of the door panel, wherein the pair of actuators move the rod in synchrony with each other.

11. The door assembly as set forth in 8, wherein the top end of the link includes an elongated slot, the top portion of the door panel having a second pin configured to travel within the elongated slot.

12. The door assembly as set forth in claim 8, wherein the actuator is a hydraulic cylinder.

13. The door assembly as set forth in claim 8, further including a first pin support fixedly mounted on the door panel, the first pin support having a bore configured to rotatingly receive the first pin.

14. The door assembly as set forth in claim 8, further including a second pin support having a second pin, the second pin support fixedly mounted to a top portion of the door panel, a top end of the link rotatably mounted to the second pin.

* * * * *